United States Patent [19]

Hunter et al.

[11] Patent Number: 4,519,284

[45] Date of Patent: May 28, 1985

[54] UNIVERSAL SHEET METAL HOLDER

[75] Inventors: James R. Hunter, Chadds Ford; S. James Lazzarotti, Broomall, both of Pa.

[73] Assignee: The Warner & Swasey Company, Cleveland, Ohio

[21] Appl. No.: 401,446

[22] Filed: Jul. 26, 1982

[51] Int. Cl.[3] ..... B26D 5/20; B26D 7/06; B25B 1/04

[52] U.S. Cl. ..... 83/410; 83/71; 83/405; 83/409; 83/409.1; 83/277; 83/206; 269/32; 269/238; 269/315

[58] Field of Search ..... 83/71, 405, 409, 409.1, 83/410, 206, 277; 269/32, 238, 315

[56] References Cited

U.S. PATENT DOCUMENTS

| | | | |
|---|---|---|---|
| 1,810,430 | 6/1931 | Maszczyk | 269/238 |
| 3,603,187 | 9/1971 | Bredow | 83/409 X |
| 3,758,099 | 9/1973 | Scott | 269/32 X |
| 3,835,743 | 9/1974 | Taylor et al. | 83/146 |
| 4,003,478 | 1/1977 | Daniels | 83/409 X |
| 4,127,198 | 11/1978 | Morini | 214/1 BT |
| 4,165,667 | 8/1979 | Brolund et al. | 83/409 |

*Primary Examiner*—Paul A. Bell
*Assistant Examiner*—Taylor J. Ross
*Attorney, Agent, or Firm*—Howard G. Massung

[57] ABSTRACT

A punch press (20) having a worktable (40) for supporting a worksheet (21), a two axis positioning mechanism for positioning the worksheet under a punching head (34) and universal grippers (44, 46) supported on the worksheet positioning mechanism which can grip either the end or sides of a worksheet (21). The two axis positioning mechanism is formed from a carriage (42) which is movable along the worktable (40) and a cross slide (41) which is mounted from and movable across the carriage (42) to provide the two axis sheet positioning. The grippers (44, 46) are mounted from a T-slot (130) formed in the cross slide (41) and can be moved to different positions to accommodate various sheet sizes. Aligning pins (140, 142, 143, 144) which can be used for aligning worksheets are provided. Aligning pins (140, 142, 143, 144) during operation are retracted beneath the worktable (40).

18 Claims, 15 Drawing Figures

UNIVERSAL SHEET METAL HOLDER

BACKGROUND OF THE INVENTION

1. Cross Reference to Related Application

This application is related to co-pending U.S. patent application Ser. No. 401,444 entitled "Bridge Type Press Frame" and U.S. patent application Ser. No. 401,445 entitled "Punch Head for a Punch Press" which are assigned to the assignee of the present invention.

2. Technical Field

The invention relates to metal working and more particularly to a versatile sheet metal gripper.

3. Background Art

Sheet metal grippers are well known in the art. U.S. Pat. Nos. 3,603,187; 3,835,743; and 4,127,198 disclose exemplary prior art sheet metal grippers. A disadvantage of most prior art sheet metal grippers is that they grip only on one axis of a sheet metal workpiece.

DISCLOSURE OF THE PRESENT INVENTION

The present invention discloses a universal sheet metal gripper which grips the end or sides of a piece of sheet metal. The disclosed grippers are mounted on a cross slide which is movably supported from a bridge type carriage. The carriage arrangement when utilized with a sheet metal support table permits sheet metal workpieces to be loaded from the side or from the front end of the press. When the sheet metal workpiece is loaded from the side of the machine onto the sheet positioning table, the disclosed grippers grip one end of the workpiece in a conventional manner. A retractable pin is used in conjunction with the grippers for aligning the worksheet. When a sheet metal worksheet is loaded from the front of the table, the disclosed grippers engage opposite sides of the worksheet. A plurality of retractable pins are provided for aligning the worksheet before opposite sides are engaged by the grippers.

BRIEF DESCRIPTION OF THE DRAWINGS

For a better understanding of the invention, reference may be had to the preferred embodiment exemplary of the invention shown in the accompanying drawings in which.

BEST MODE FOR CARRYING OUT THE INVENTION

Figure 1:
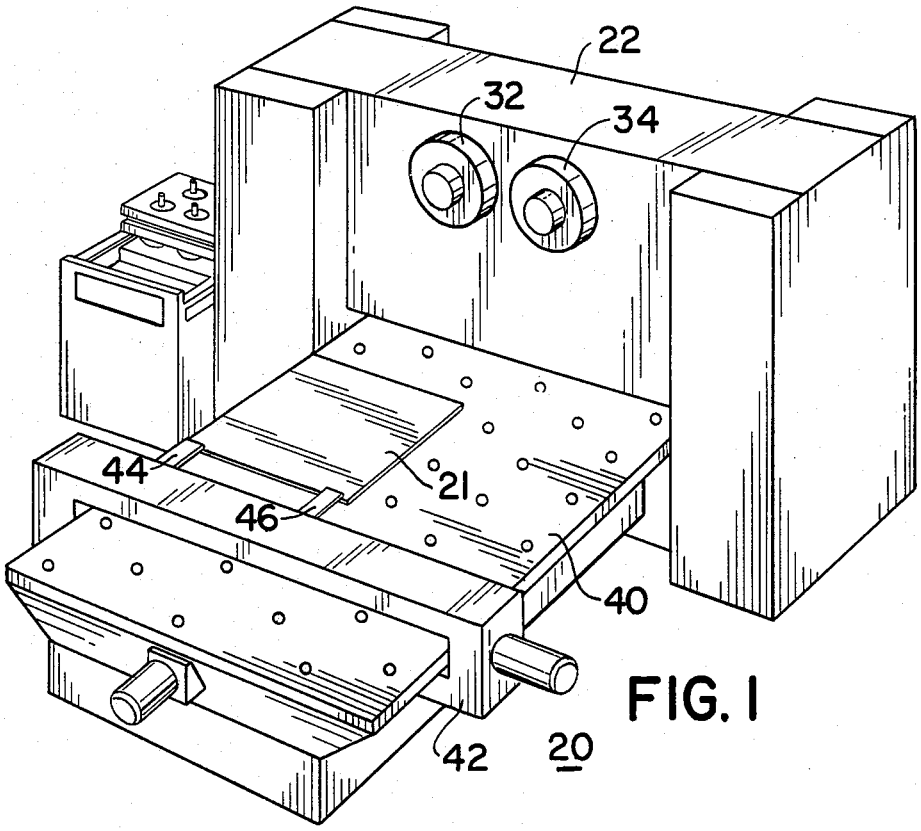
FIG. 1 is an isometric view of a punch press utilizing sheet metal workpiece grippers according to the present invention.
Figure 5:
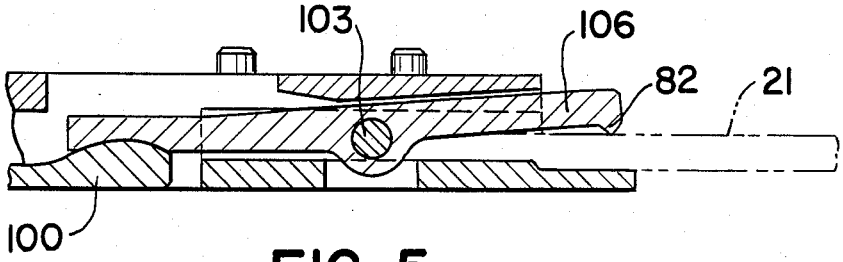
FIG. 5 is a section view of a portion of the gripper shown at FIG. 3 along the lines V—V.
Figure 6:
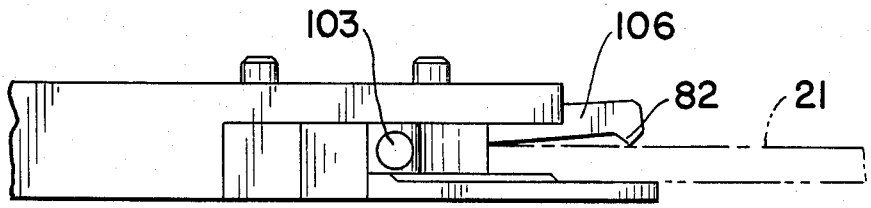
FIG. 6 is a view of a portion of the gripper shown in FIG. 3 along the lines VI—VI.
Figure 2:
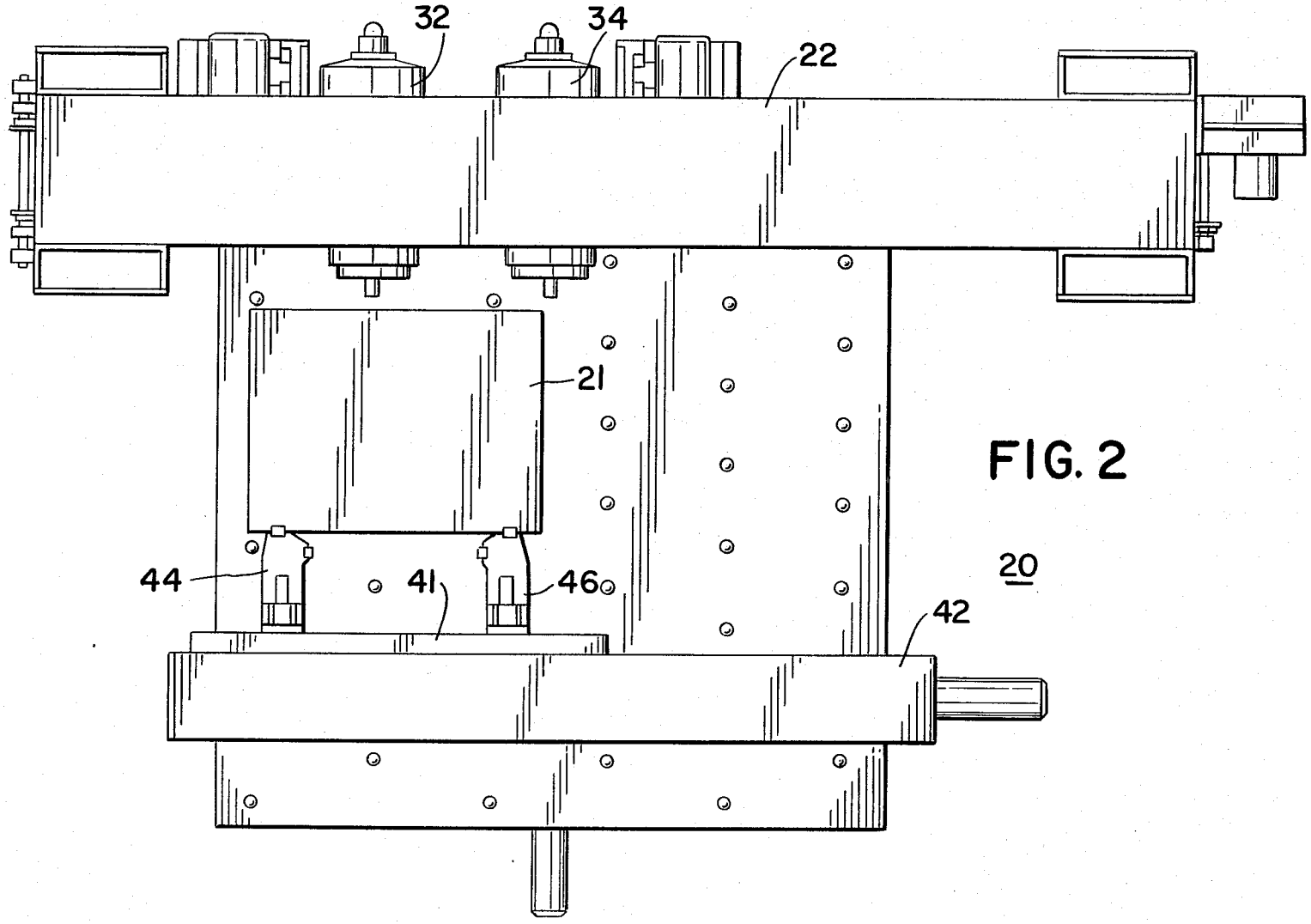
FIG. 2 is a top view of the punch press shown in FIG. 1.
Figure 3:
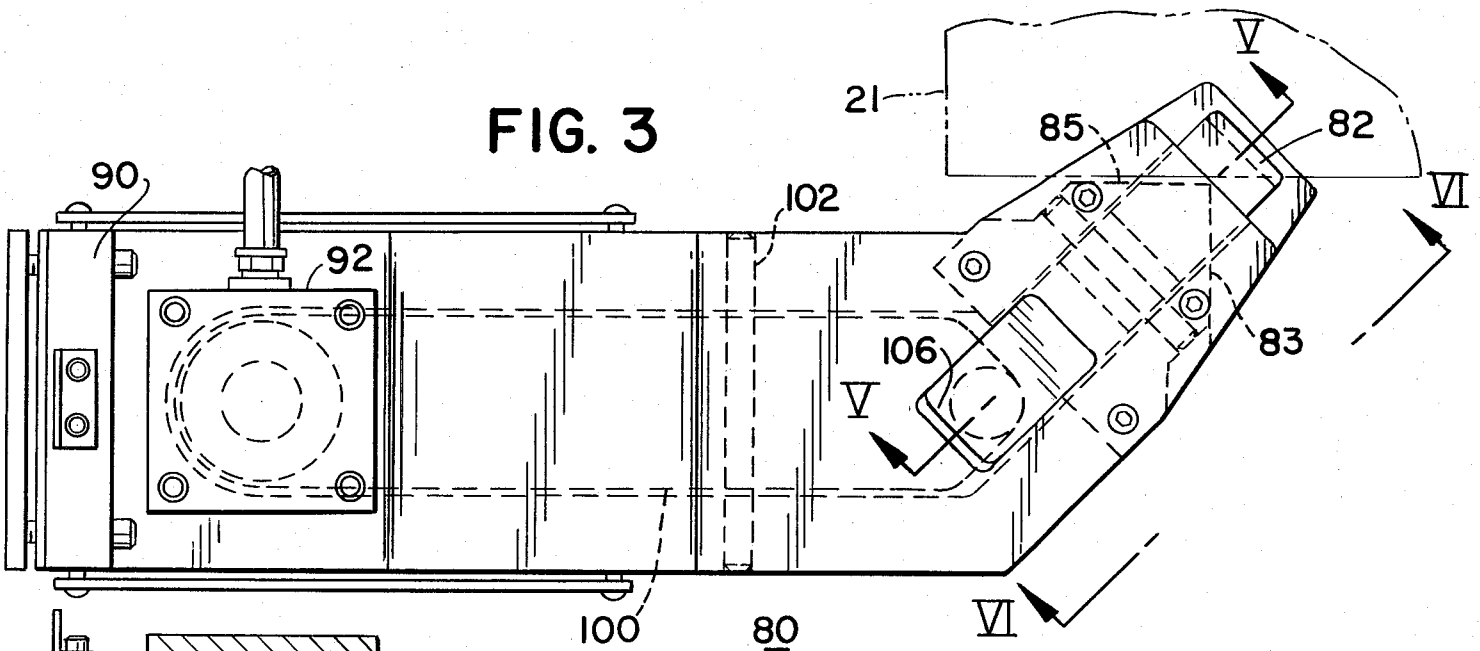
FIG. 3 is a top view of one sheet metal gripper constructed according to the present invention.
Figure 4:
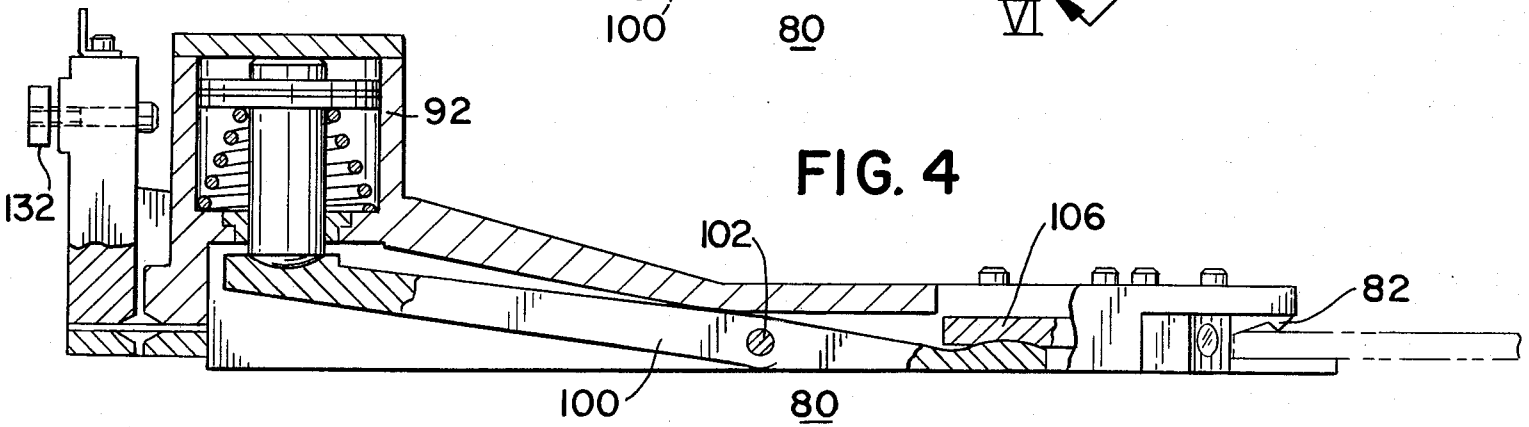
FIG. 4 is a side view of the gripper of FIG. 3 with portions broken away for clarity.

Referring now to the drawings, there is shown in FIGS. 1 and 2 a punch press 20 utilizing sheet metal grippers 44,46 constructed according to the present invention. Punch press 20 consists of a bridge type punch head structure 22 and a workpiece support table 40 which are connected together to form an integral structure. A pair of punching heads 32 and 34 are provided on the bridge punching frame 22. A bridge type sheet metal positioning carriage 42 is movable toward and away from the punching heads 32, 34. The pair of sheet metal grippers 44 and 46 are supported by a cross slide 41 that is movable along carriage 42. Movement of carriage 42 and cross slide 41, which holds sheet metal grippers 44 and 46 on carriage 42, provides for two axes, X-Y, positioning of a sheet metal workpiece 21. The disclosed grippers 44, 46 are particularly suitable for use on a punch press as disclosed in co-pending U.S. patent application Ser. No. 401,444 entitled "A Bridge Type Punch Press" whose teachings are herein incorporated by reference.

Figure 10:
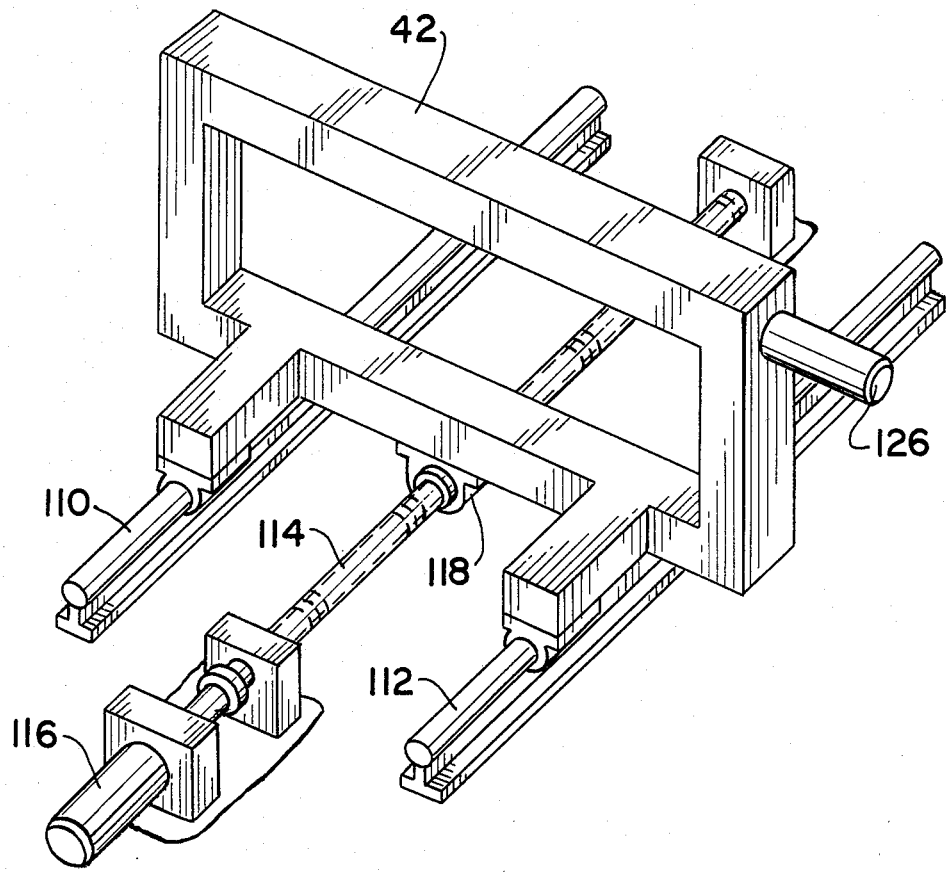
FIG. 10 is a view of the carriage and its drive.
Figure 11:
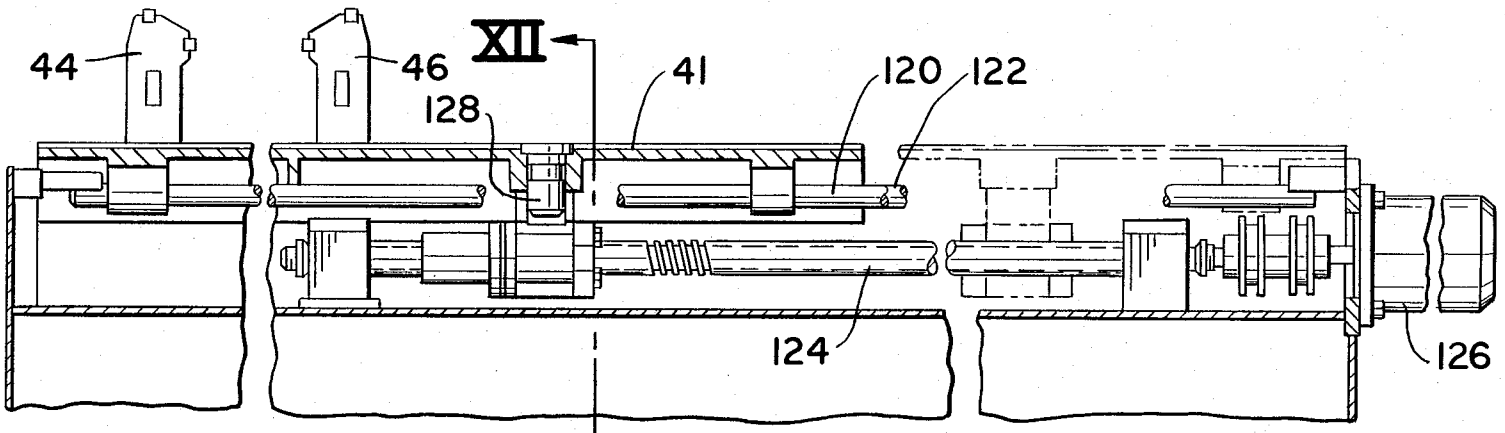
FIG. 11 is a section view of the cross slide and its drive.
Figure 12:
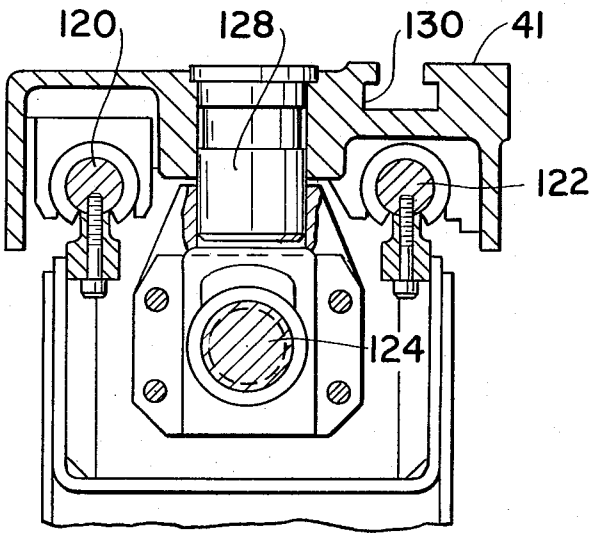
FIG. 12 is an enlarged section view taken in FIG. 11 along the line XII—XII.

Referring now to FIGS. 10 thru 12 there is shown in more detail the mechanism for positioning carriage 42 and cross slide 41. Carriage 42 rides on linear bearings moving on a pair of linear way 110, 112. A ball screw 114 is driven by a Y axis servo motor 116. Ball screw nut 118 is attached to carriage 42 to position carriage 42 in response to operation of servo motor 116. Supported by carriage 42 is a cross slide member 41. Cross slide 41 is supported for linear movement by ball bushing rails 120, 122. A ball screw 124, which is supported in carriage 42 is driven by a servo motor 126. Ball screw nut pin assembly 128 connects ball screw 124 to cross slide 41. Cross slide 41 is thus positioned in the X direction in response to operation of servo motor 126.

Workholders 44 and 46 are attached to cross slide member 41 which is positionable along carriage 42. A T-slot 30 is formed in cross slide member 41 for engaging a mating block 132 secured to workholders 44, 46. Two bolts which engage block 132 are provided for securing workholders 44, 46 to cross slide 41. With this construction the location of the workholder 44, 46 on the cross slide 41 is adjustable by the operator to properly engage the panel being punched. During operation both workholders are adjusted to their desired settings and the screws tightened to pull block 132 into firm engagement with T-slot 130 so as to firmly affix the workholder to cross slide 41 to move as an entity.

Figure 7:
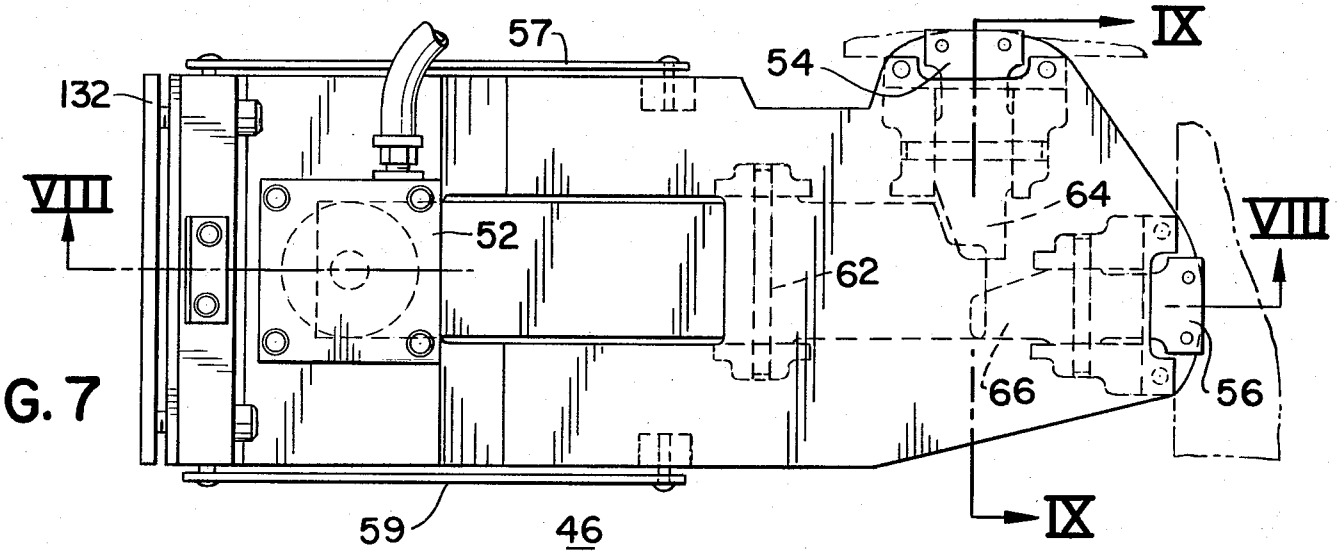
FIG. 7 is a top view of another embodiment of the sheet metal gripper according to the present invention.
Figure 9:
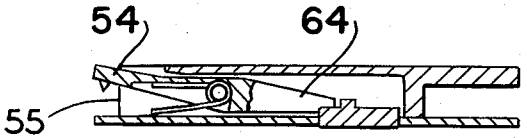
FIG. 9 is a section view taken in FIG. 7 along the line IX—IX.
Figure 8:
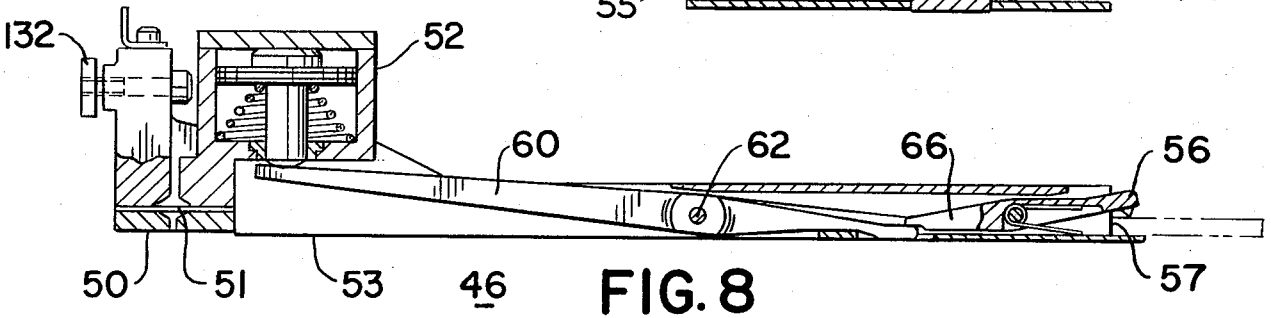
FIG. 8 is a section view taken in FIG. 7 along the line VIII—VIII.

Referring now to FIGS. 7 through 9 there is shown in more detail the construction of sheet metal gripper 46. Gripper 46 is formed from a bracket member 50 which is supported from cross slide 41. A flexible member 51 connects an actuating member 53 to bracket 50. A pair of side arm assemblies 157, 59 extend from bracket 50 and provide some support for actuating member 53. An operator such as air cylinder 52, is disposed on member 50 and is actuated in response to an appropriate signal for operating gripper 46. Gripper 46 has side gripper jaw 54 and an end gripper jaw 56. Only one gripper jaw 54, 56 is used as any one time on a workpiece 21. Air cylinder 52 is positioned to move pivot arm 60 about a pivot connection 62. A side pivot link 64, having pivot jaw 54 formed at one end thereof, and an end pivot link 66, having pivot jaw 56 formed at one end thereof, are positioned to be moved by pivot arm 60. When a sheet metal workpiece is in position to be gripped, air cylinder 52 is actuated moving pivot arm 60 around pivot point 62 which in turn moves side pivot link 64 and end pivot link 66 about their respective pivot supports to engage the sheet metal workpiece.

Gripper 46 includes a front aligning surface 57 gripping the workpiece by its end. Gripper 46 also includes a side surface 55 which is spaced from the side of a worksheet when gripping a worksheet on its sides. Gripping jaws 54, 56 extend beyond their associated surfaces 55, 57 for engaging the workpiece.

Construction of gripper 44 is similar to construction of gripper 46, the main difference being the side gripper jaws are disposed to grip the opposite side of the sheet metal workpiece 21. When the sheet metal workpice 21 is loaded from the side of the punch press 20 the end of the workpiece is gripped by activating jaws 56. When a sheet metal workpiece 21 is loaded from the end of punch press 20 grippers 44, 46 are separated sufficiently to allow the workpiece 21 to pass therebetween. When the workpiece is in the proper location, the side gripper jaws 54 are activated to grip opposite sides of the workpiece 21. It can thus be seen that grippers 44 and 46 can grip either the end or sides of a workpiece 21.

Locator pins are provided for accurately locating the sheet metal workpiece 21 with respect to the punching heads before gripping. Various pins which are raised for positioning a worksheet are provided on the worktable 40.

Figure 13:
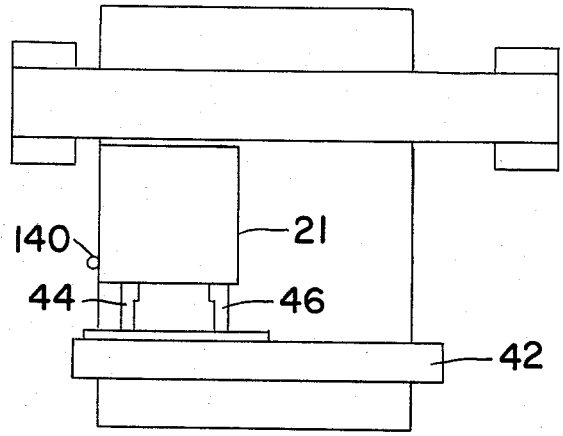
FIG. 13 is a top view of the punch press showing the locator pin for end gripping of a worksheet.
Figure 14:
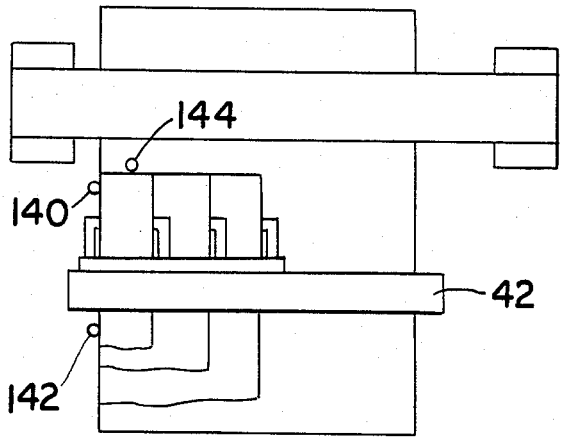
FIG. 14 is a top view of the punch press showing the locator pins for side gripping of a worksheet; and, FIG. 15 is a top view of the punch press having two sets of grippers.
Figure 15:
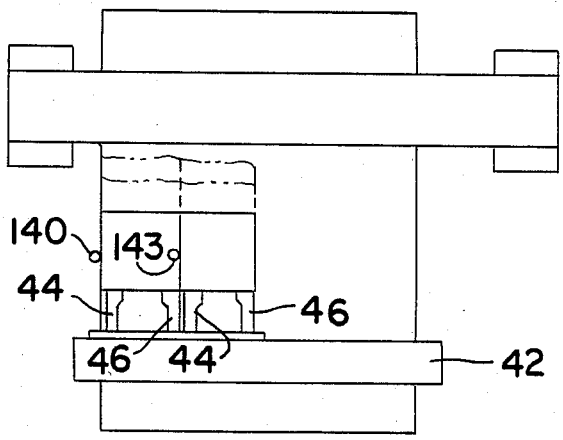

Referring now to FIGS. 13, 14 and 15 there is shown a worktable and various locator pins which are used for aligning a worksheet 21. FIG. 13 shows a single locator pin 140 which is provided for positioning a side loaded sheet. The end grippers on workholders 44 and 46 grip the end of the worksheet 21. The worksheet is positioned with respect to the punch heads in the Y-direction by being in firm contact with the front aligning surface 57 of workholders 44, 6. The worksheet is positioned in the X-axis direction by being positioned in firm contact with locator pin 140 that is moved up to register with the sheet during positioning. Pin 140 is retracted before the sheet is moved and punching starts.

Gripping jaws 54 located on the side of workholders 44, 46 are placed in a different manner. Surface 55 of grippers 44, 46 is not a reference surface for the worksheet. Instead the worksheets are loaded and oriented as shown in FIG. 14. The workholders 44, 46 are positioned to provide a clearance between the workpiece and surface 55 for both the left hand workholder 44 and the right workholder 46. The worksheet is actually positioned in the X-axis by being moved into firm contact with two locator pins 140 and 142. The sheet is then moved inward in a Y-axis direction to contact a third locator pin 144. Workholders 44, 46 are simply positioned in the T-slot provided in cross slide 41 to grip the sides of the workpiece 21 with a suitable clearance gap between the surface 55, provided adjacent with gripper jaw 54, and the worksheet. The purpose of a clearance gap between the worksheet 21 and the side grippers 54 of each workholders is to allow for repositioning of the carriage to grab the worksheet in a different location. This regripping process is necessary when punching a sheet which is longer than the available Y-axis travel of carriage 42. The sheet will be initially punched for the amount of Y-axis travel and then the sheet will be clamped to the table by means of clamping or repositioning cylinders. The workholder jaws are then opened and the carriage 42 and supported grippers 44, 46 moved to a new position and the workholder jaws are reclosed and the repositioning clamps released. Punch press 20 is then ready to punch holes in a new area of the overlength worksheet. The purpose of the clearance gap between the worksheet 21 and surfaces 55 is to compensate for the edges of a worksheet which may not be perfectly straight and square. If workholders 44 and 46 were set up with no gap between surface 55 and the sheet was to be repositioned workholders 44 and 46 could very wall scuff and bind against the worksheet when an attempt was made to reposition the carriage to a new location.

Referring now to FIG. 15 there is shown a carriage 42 and locator pin arrangement for supporting two worksheets on punch press 20. A first worksheet is loaded from the side onto punch press 20. This first worksheet is properly aligned by the pair of grippers 44, 46 and locator pin 143. Locator pin 143, which is retractable, is then lowered and a second worksheet is positioned on punch press 20. A second set of grippers 44, 46 are added to cross slide 41. The second set of grippers 44, 46 are positioned in the T-shaped opening of cross slide 41. The second set of grippers 44, 46 and locator pin 140 are used to properly align the second worksheet. Locator pin 140 is then lowered and the two worksheets are moved into position to be punched. Various other arrangements of locator pins and grippers can be provided for gripping two worksheets.

Referring now to FIGS. 3 through 6, there is shown a second embodiment of a universal worksheet gripper. Gripper 80 includes only one gripper jaw 82 which is angled and extended for gripping either the end or side of a work sheet. Gripper 80 includes a bracket 90 which can be attached to the T-slot 130 in cross slide 41 in the same fashion as described above for grippers 44, 46. An operating cylinder 92 is supported from bracket 90 and is used for positioning a pivot arm 100. Pivot arm 100 is supported for pivotal movement about a pivot support pin 102. Gripper jaw 82 is formed at the end of a pivot link 106. Pivot link 106 is pivotable about a support pin 103 for moving gripper jaw 82 into engagement with a worksheet 21. Gripper 80 includes a front surface 83 which is aligned with the end of a workpiece when gripping the workpiece on the end. Gripper 80 also includes a side surface 84 which is spaced from the side of a workpiece when gripping a workpiece on a side. The gap is left between surface 85 and the workpiece 21 for the reasons given above for side gripping by grippers 44, 46. Gripping jaw 82 extends beyond surface 83, 85 for gripping either a side or end of a workpiece.

Gripper 80 can grip either the end or side of a worksheet with virtually the entire contact length of gripper jaw 82 in engagement with the worksheet. During use a second gripper similar to gripper 80 but formed for gripping an opposite side of the sheet metal workpiece is provided on cross slide 41 supported from carriage 42. These two grippers work in conjunction for gripping either the end or opposite sides of a workpiece.

We claim:

1.

A punch press having a punching head, a worksheet support table, a worksheet positioning mechanism for two axis positioning of a worksheet relative to the punch head with the worksheet having an end and two parallel sides which extend substantially perpendicular to the end, characterized by:

a pair of grippers extending from said workpiece positioning mechanism, constructed and positionable at a first position along the opposite sides of the worksheet for gripping the sides of the worksheet which extend past said grippers and, alternately at a second position along the end of the worksheet for gripping the end of a worksheet which extends across the front of said grippers.

2. A punch press as claimed in claim 1 characterized by:

a first pair of gripping jaws extending from the front end of each gripper for gripping the end of the worksheet and, a second pair of gripping jaws extending from the side of each gripper for gripping the side of the worksheet.

3. A punch press as claimed in claim 1 characterized by:

each of said pair of grippers includes a pair of workpiece gripping jaws extending transversely therefrom for gripping a worksheet along a gripping line which extends transverse to the gripper.

4. A punch press as claimed in claim 1 characterized by:

a front aligning surface on each of said grippers for aligning the end of a worksheet when gripping the end of a worksheet.

5. A punch press as claimed in claim 4 characterized by:

a plurality of aligning pins movable between a raised position for aligning the worksheet and a lowered position beneath the worksheet support table.

6. Positioning apparatus for positioning a worksheet comprising:

a worktable for supporting the worksheet;

a carriage extending above and across said worktable permitting full access to sid worktable beneath said carriage and being movable along said worktable;

a cross slide supported from and movable across said carriage;

a pair of sheet metal grippers extending from and supported by said cross slide and movable along said cross slide; and, each of said pair of grippers constructed to grip a side of the worksheet, extending perpendicular to and beneath said carriage, and alternately to grip an end of the worksheet, extending parallel to said carriage across the front of said pair of grippers.

7. Positioning apparatus as claimed in claim 6 wherein said gripper comprises:

a first pair of gripping jaws extending from the end of each gripper for gripping the end of the worksheet extending parallel to the carriage; and, a second pair of gripping jaws extending from the side of each gripper for gripping the side of the worksheet which extends perpendicular to the carriage.

8. Positioning apparatus as claimed in claim 6 comprising:

a pair of workpiece gripping jaws extending at an angle from the end of each said gripper for gripping a worksheet along a gripping line which extends transverse to said carriage.

9. Positioning apparatus as claimed in claim 6 wherein each gripper comprises:

an aligning surface for aligning with the end of the worksheet extending parallel to said carriage;

a first pair of gripping elements disposed to grip the end of the worksheet aligned with said first aligning surface; and, a second pair of gripping elements disposed to grip the side of the worksheet.

10. Positioning apparatus as claimed in claim 9 comprising:

first aligning means movable from a retracted position beneath said worktable to a raised position above said worktable for use in conjunction with said aligning surface for aligning the worksheet which is to be gripped by its end.

11. Positioning apparatus as claimed in claim 9 comprising:

second aligning means movable from a retracted position beneath said worktable to a raised position above said worktable for aligning the worksheet which is to be gripped on its sides;

12. Worksheet positioning apparatus as claimed in claim 6 comprising:

a first aligning surface formed at the end of said gripper for aligning with the end of the worksheet;

a second surface formed on the side of said gripper;

a pair of gripping elements extending from said gripper beyond said first aligning surface and said second surface for gripping a worksheet which is either aligned with said first aligning surface or in close proximity to said second surface.

13. Positioning apparatus as claimed in claim 6 wherein each of said pair of grippers comprises:

a main lever;

an actuator for positioning said main lever;

at least one secondary lever having a gripping jaw formed on one end thereof movable in response to positioning of said main lever.

14. Worksheet positioning apparatus comprising:

a worktable for supporting the worksheet;

a carriage extending across said worktable and movable with respect thereto along said worktable;

a cross slide supported from and movable across said carriage;

a pair of grippers adjustably supported on said cross slide and movable therewith;

each gripper comprises a first reference surface for aligning with an end of the worksheet which extends parallel to said carriage, a second reference surface positioned in proximity to a side of the worksheet which extends perpendicular to said carriage; and, gripping means for gripping the worksheet aligned with either said first reference surface or in proximity to said second reference surface.

15. Worksheet positioning apparatus as claimed in claim 14 wherein:

said gripping apparatus comprises a gripping element extending at an angle to the first and second reference surfaces and having a gripping line extending transverse to the first and second reference surfaces.

16. Worksheet positioning apparatus as claimed in claim 14 comprising:

first gripping means extending from the side of each gripper for use when gripping the side of the worksheet; and, second gripping means extending from the end of each gripper for use when gripping the end of the worksheet.

17. A machine for positioning a worksheet comprising:

a worksheet support table for supporting the worksheet;

a worksheet positioning mechanism for two-axis positioning of the worksheet;

a pair of grippers extending from said worksheet positioning mechanism and constructed for gripping either the end of a worksheet which extends across the front of the grippers or the sides of a worksheet which extend along the grippers; and, each of said pair of grippers comprises a first pair of gripping jaws extending the front end of said gripper for gripping the end of the worksheet, and a second pair of gripping jaws extending from the side of said gripper for gripping the side of the worksheet.

18. A machine for positioning a worksheet having an end and parallel sides comprising:

a worksheet support table;

a worksheet positionin mechanism for two-axis positioning of the worksheet;

a pair of grippers extending from said worksheet positioning mechanism constructed for gripping either the end of the worksheet which extends across the front of the grippers or the sides of the worksheet which extend along the grippers; and, each of said pair of grippers comprises a pair of gripping jaws offset from the grippers connection to the said worksheet positioning mechanism for gripping the worksheet along a gripping line which extends transverse to the gripper permitting the gripper to grip at a first position the end of the worksheet which extends across the front of the gripper and at a second position the side of the worksheet which extends along side said gripper.

* * * * *